US006611967B1

(12) United States Patent
Hennessy et al.

(10) Patent No.: US 6,611,967 B1
(45) Date of Patent: Sep. 2, 2003

(54) DUMP BUCKET TOILET WITH CONTROLLED DISCHARGE AND RETURN

(75) Inventors: Arnold Hennessy, Wellington (CA); Philip Hennessy, Picton (CA); Myron Ament, Bethel Park, PA (US)

(73) Assignee: Flapperless, Inc., Toronto (CA)

( * ) Notice: Subject to any disclaimer, the term of this patent is extended or adjusted under 35 U.S.C. 154(b) by 0 days.

(21) Appl. No.: 10/164,673

(22) Filed: Jun. 6, 2002

(51) Int. Cl.[7] ..... E03D 1/20
(52) U.S. Cl. ..... 4/365
(58) Field of Search ..... 4/365

(56) References Cited

U.S. PATENT DOCUMENTS 1,265,890 A * 5/1918 Egan ..... 4/365
1,670,975 A * 5/1928 McCleery ..... 4/365
2,199,068 A * 4/1940 Egenas ..... 4/365
4,646,369 A * 3/1987 Brown et al. ..... 4/365
5,887,293 A 3/1999 Hennessy

FOREIGN PATENT DOCUMENTS

GB 441374 * 1/1936 ..... 4/365

* cited by examiner

*Primary Examiner*—Charles E. Phillips
(74) *Attorney, Agent, or Firm*—Leon D. Rosen

(57) ABSTRACT

A dump bucket toilet that enables the construction of a toilet that has a low profile and that avoids splashing of water. A barrier (90) lies over much of the first side portion of the bucket to prevent the very rapid discharge of water from the bucket into the surrounding tank when the bucket is tipped, but to instead allow water to be discharged through an opening (92) of moderate size. This avoids splashing and keeps the bucket in it dump position for a few seconds to avoid the bucket scooping up water at the bottom of the tank. A return wall (120) at the bottom of the middle of the tank retains water at a second side portion of the tipped bucket to urge the bucket to tilt back to the filled position.

6 Claims, 3 Drawing Sheets

DUMP BUCKET TOILET WITH CONTROLLED DISCHARGE AND RETURN

BACKGROUND OF THE INVENTION

In a dump bucket toilet, a bucket that lies within a tank can be tilted to discharge substantially all water into the tank, the water flowing to a toilet bowl to flush out its contents. When the bucket is tilted, the water rapidly rushing out of the bucket can splash. To prevent water from leaking out of the top of tank, barriers are required to limit the effect of the splashing. As soon as the bucket has been tilted to a dump position, it tends to quickly return to its fill position for refilling with water. The bucket may scoop up some of the water in the tank, which results in much less than all of the water being used and which results in an incomplete flush. This is prevented by placing the bucket higher above the bottom of the toilet tank, but this results in a taller toilet tank which is undesirable. In some instances, the toilet pivots back from the dump position only partially towards the fill position, and remains in the in between position under the force of the refill water flowing into the bucket. This can be prevented by weighting the bucket, but then the bucket requires more torque to initially pivot it, and the bucket pivots back fast enough to make a noticeable sound, both of which are undesirable. A dump bucket toilet that avoided these disadvantages, would be of value.

SUMMARY OF THE INVENTION

In accordance with one embodiment, a dump bucket toilet is provided which avoids substantial scooping of water by the bucket as it returns towards the fill position, to enable a toilet tank of low height to be used. The bucket can be initially tilted with a low force, and yet reliably returns to the filled position while making minimal noise. The bucket has first and second sides adjacent respectively to first and second sides of the toilet tank, and is pivotable about a longitudinally-extending tilt axis. The bucket carries a barrier that lies over a first side portion of the bucket. As a result, when the bucket is tiled so its first side is lowered, the barrier resists rapid discharge of the water and consequent splashing. The barrier forms an opening at the top of the first bucket side, through which water can flow out at a moderate rate, which avoids splashing and which keeps the toilet tilted for a few seconds while substantially all of the water is discharged. This avoids the bucket scooping water and the need for a taller gap between the bottom of the bucket and the bottom of the tank.

A return wall lies in the bucket near its bottom. When the bucket tilts to its dump position and then tilts partially back to an in between position, the return wall retains water on a second side of the pivot axis, to apply torque urging the bucket back towards the fill position.

The novel features of the invention are, set forth with particularity in the appended claims. The invention will be best understood from the following description when read in conjunction with the accompanying drawings.

DESCRIPTION OF THE PREFERRED EMBODIMENTS

Figure 1:
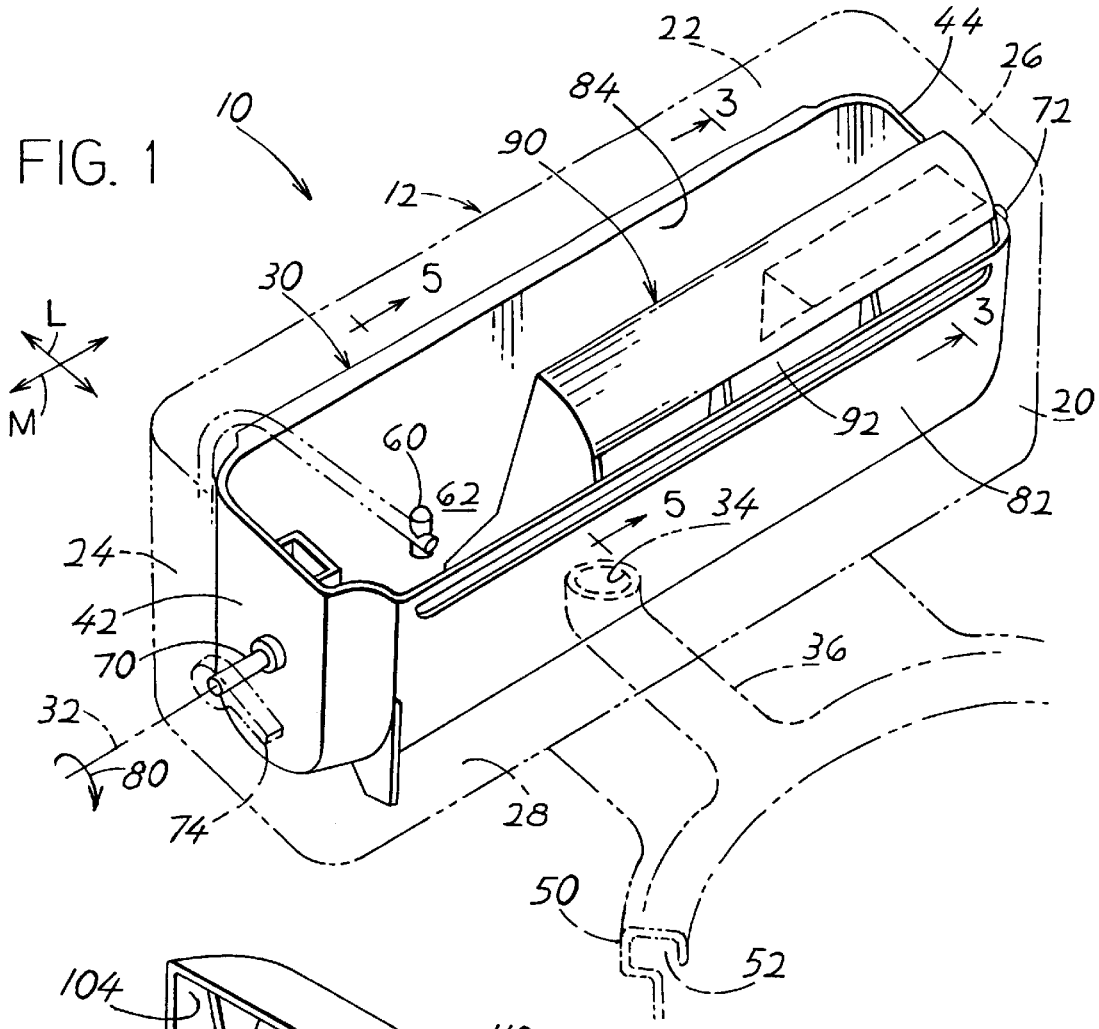
FIG. 1 is a front and top isometric view of a portion of a toilet constructed in accordance with the present invention, with the bucket shown in a fill position and the tank shown in phantom lines.

FIG. 1 illustrates a dump bucket toilet 10 of the present invention, which includes a toilet tank 12 having laterally L opposite tank sides 20, 22, longitudinally M opposite tank ends 24, 26, and a tank bottom wall 28. A bucket 30 lies within the tank and is pivotable about a longitudinal tilt axis 32, to dump water lying in the bucket 30 into the tank 12. The tank bottom wall has a water exit hole 34 through which water passes to flow along a water tunnel 36 to a toilet bowl 50 to discharge the water through openings 52 in the rim of the toilet bowl.

Each time the bucket is tilted to discharge its water into the tank, water from a refill valve 60 flows water into the bucket to refill it, until the refill valve senses that the bucket is filled, and then stops. The refill valve 60 directs water into a first end portion 62 of the bucket, which is closest to the first or primary end 42 of the bucket.

The bucket primary and secondary ends 42, 44 carry short shafts or trunnions 70, 72 that project along the tilt axis 32. The trunnions are pivotally mounted in bearings (not shown) in the end walls 24, 26 of the tank. A handle 74 fixed to a portion of trunnion 70 that projects beyond the tank, can be depressed to tilt the tank from the fill position to a tilted dump position. During such tilting in the tipping direction of arrow 80, a first side 82 of the bucket moves down while an opposite second side 84 moves up. As the bucket tilts perhaps 100° in the tipping direction 80, water in the bucket is discharged into the tank 12 and rapidly flows out through the water exit hole 34.

Applicant provides a lid or barrier 90 which lies above a first side portion 91 (FIG. 3) of the bucket (opposite a second side portion 93) that lies adjacent to the first bucket side 82, the barrier extending at least partially towards the bucket second side 84. The purpose of the barrier 90 is to prevent a sudden dumping of substantially all of the contents of the bucket into the tank, as this can result in splashing of the water. The splashed water can find its way to the top of the tank and cause a few droplets to leak out, which is undesirable. The barrier 90 forms a gap opening 92 between itself and the top of the first bucket side 82, and much of the water in the tank can flow out at a moderate rate through the gap opening into the tank. Such moderation of outflow of water greatly reduces splashing. The barrier preferably extends as part of a cylinder centered on the pivot axis from the top 130 of the bucket first side, to avoid requiring an increase in tank width, while providing more volume to hold dumped water. The longitudinal M length of the barrier is more than one-third the length of the bucket.

Figure 2:
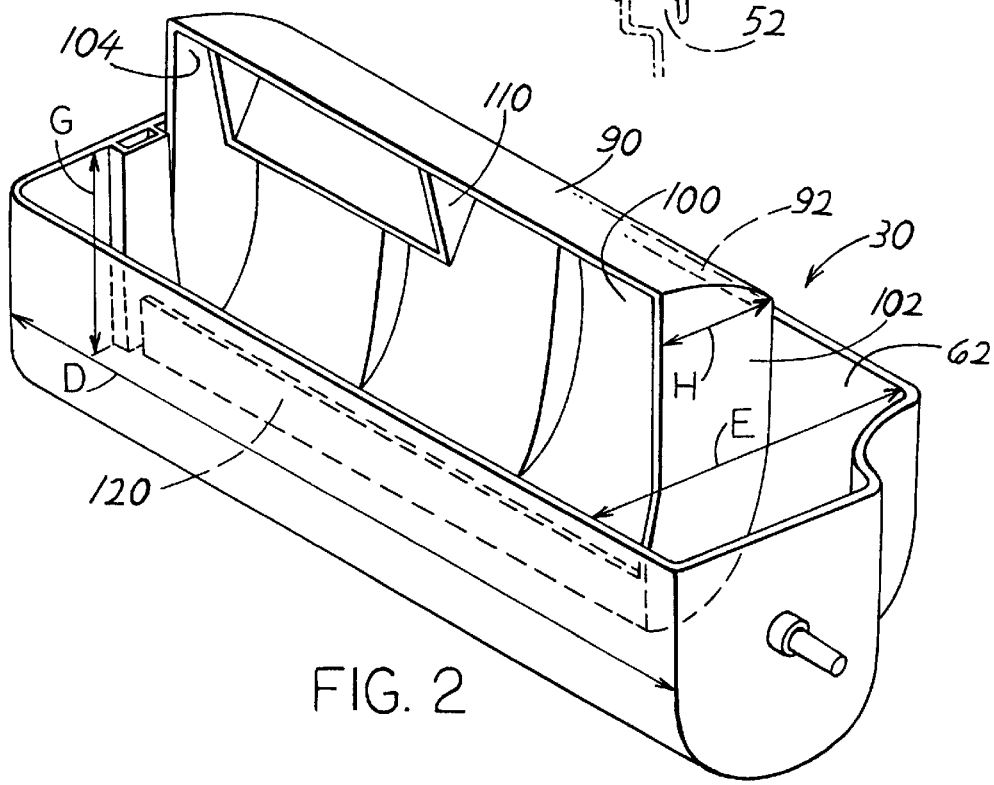
FIG. 2 is a rear and top isometric view of only the bucket of the toilet of FIG. 1.

As also shown in FIG. 2, the dump bucket forms a hold-down container 100 with longitudinally-opposite end walls 102, 104. The barrier 90 lies at the top of the hold-down container. The end wall 102 limits the rapid outflow of water in the bucket being tilted, through the first end portion 62. The bucket is also provided with an axillary container 110 that traps water and slowly empties the water into the hold-down container 100. The bucket also has a return wall 120 that traps water when the bucket has been tilted to its dump position and then pivots back only partially to an in between position, to help return the bucket to the initial fill position.

Figure 3:
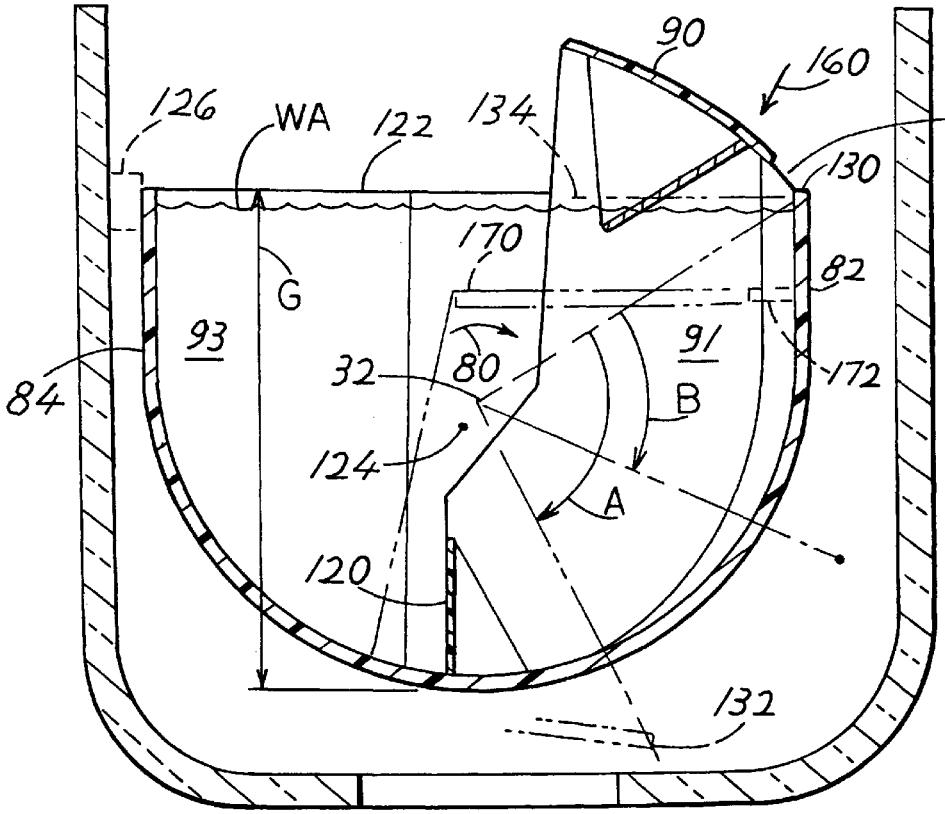
FIG. 3 is a sectional view taken on line 3—3 of FIG. 1, with the bucket in the fill position.

FIG. 3 shows the bucket in its fill position, wherein the level of water at WA lies near the top 122 of the bucket. The bucket is shaped so the center of gravity at 124 is slightly below the pivot axis 32 and lies slightly closer to the second side 84 of the bucket then to the first side 82. A stop indicted at 126 can hold the bucket in this fill position.

When the handle is depressed and the bucket turns in the tipping direction 80, the bucket tilts by an angle A of about 95° to 100° to a dump position. The top 130 of the bucket first side 82 moves to the position 132. A stop (not shown) prevents the bucket from tilting any further than the position 132. The dump position is almost always between 60° and 120° away from the fill position.

Figure 4:
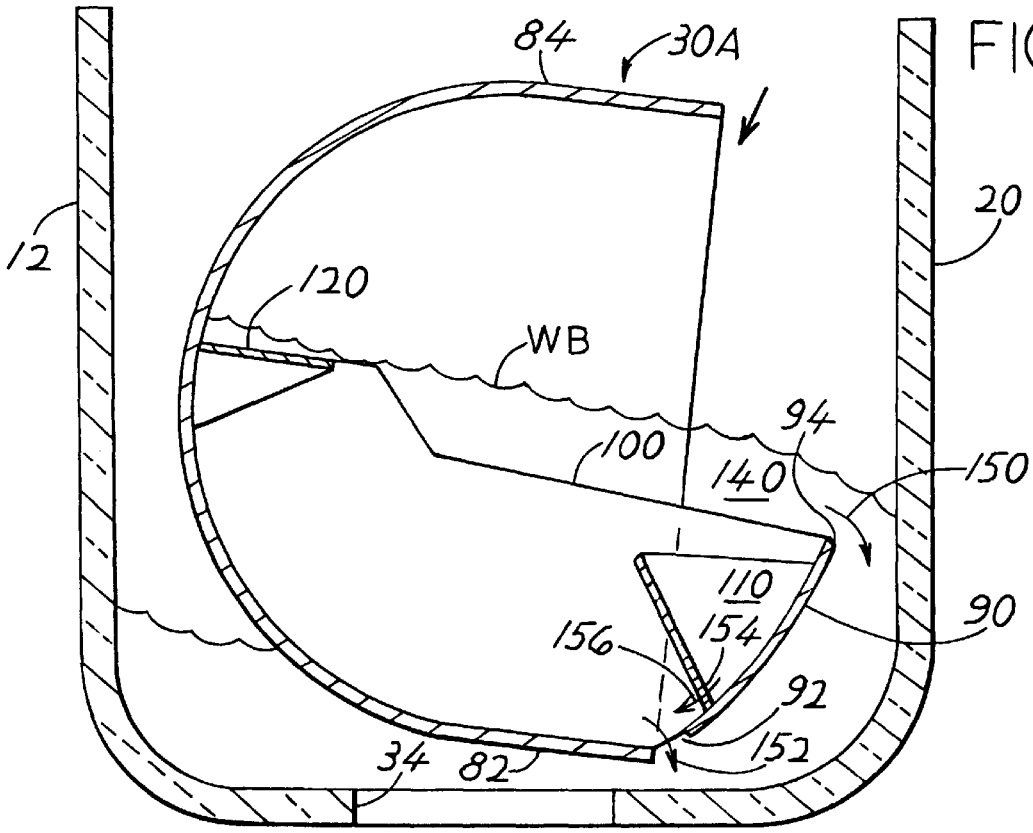
FIG. 4 is a sectional view similar to FIG. 3, but with the bucket in a dump position.

FIG. 4 shows the bucket at 30A as it reaches the dump position. The water WB tends to be thrown out of the bucket and against the first side 20 of the tank. However, the barrier 90 greatly limits the amount of water that is forcefully thrown out of the bucket. A volume 134 between the refill waterline WA and the barrier 90 receives some of the water. In FIG. 4, a moderate amount of water at 140 flows over the far side 94 of the barrier 90 into the tank.

The barrier has an average width less than half the width of the top of the bucket. The rest of the water in the hold-down container 100 can exit only through the gap opening 92 between the top of the bucket first side 82 and an adjacent edge of the barrier 90. It is noted that it is possible to extend the barrier 90 further across the width of the bucket toward the second side 84, so that substantially no water flows at 140 over the barrier, although applicant prefers to allow a small amount of water to flow over the barrier. It should be noted that considerable water flows rapidly out of the first end portion 62 (FIG. 2) of the bucket, where the barrier 90 does not lie. Applicant does not have the barrier extend over the first end portion 62, because water from the refill valve flows into the bucket through the first end portion 62. However, the hold-down container 100 preferably extends by more than half the longitudinal length of the bucket.

FIG. 4 includes arrows 150, 152 showing the paths of water flowing above and below the barrier 90. The axillary container 110 has a small hole at 154 that allows water to flow along the path 156 down and through the gap opening 92. The weight of water in the axillary container 110 and the hold-down container 100 tend to keep the bucket in its dump position shown in FIG. 4, for a total period of perhaps four or five seconds, which is long enough for almost all water at the bottom of the tank 12 to exit through the exit hole 34. This avoids the bucket scooping up water as it begins to return towards the fill position.

Figure 5:
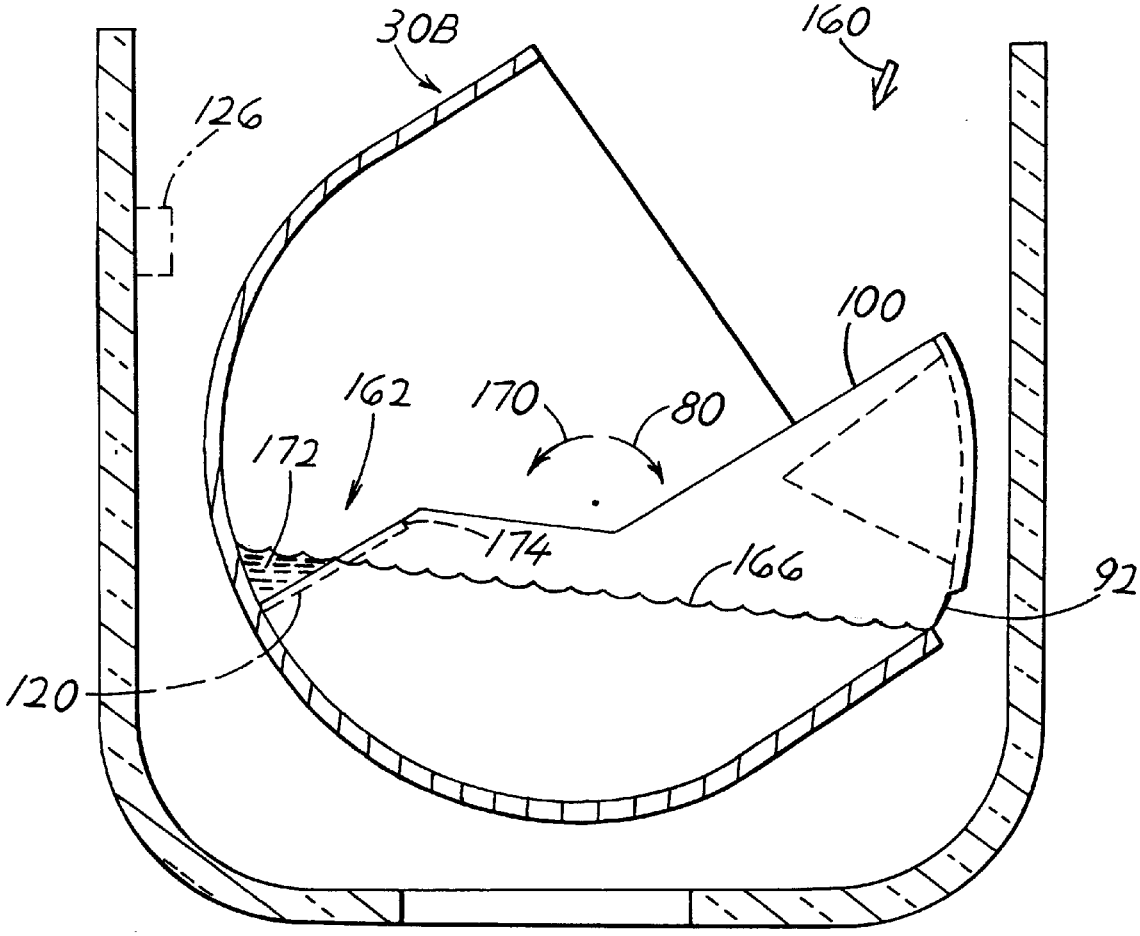
FIG. 5 is a view similar to FIG. 4, but with the bucket in an in between position and taken on line 5—5 of FIG. 1.

FIG. 5 shows the bucket at 30B in an in between position which is angled by an angle B (FIG. 3) of 55° from the fill position. Applicant finds that, unless special measures are taken, the bucket tends to slowly move to the in between at 30B (FIG. 5) and remain there indefinitely as water from the refill valve moves along the direction of arrow 160. To return the bucket to the fill position, applicant provides a return device 162 in the form of a return wall 120 that extends longitudinally along the lower end (when the bucket is in its upright fill position) of the hold-down container 100. Refill water moving along arrow 160 fills the lower portion of the bucket, as to the height 166, with additional water flowing out through the gap opening 92 into the tank. If the water at the height 166 filled the entire lower portion of the tank, this would not have any substantial effect in pivoting the bucket in the return direction 170 which is opposite the tipping direction 80. However, the return wall 164 holds a net weighting or torquing portion 172 of water. The weighting portion 172 of water is not offset by water at the bottom of the hold-down container 100 because water cannot flow from the weighting portion 172 into the hold-down container 100 unless the water rises above the top 174 of the return wall. The weight of the water in the weighting portion 172 applies torque that pivots the bucket slowly back to the fill position of FIG. 3. The slow return minimizes the amount of noise when the stop 126 is reached. It is noted that in the dump position of FIG. 4, the return wall 120 cannot hold water without such water also flowing into the hold-down container 100, so no trapped water applies a torque in the dump position of FIG. 4 that would counter the hold-down effect of water in the axillary container 110.

In a dump bucket that applicant has designed, the bucket is molded of plastic and has a longitudinal length D (FIG. 2) of 17.8 inches, a lateral width E of 6 inches and a height G of 4.75 inches. The barrier 90 has a longitudinal length of 11.5 inches and a width of 2.2 inches up to the opening 92. The return wall 120 has a height of 1.5 inches. Applicant prefers that the barrier width H be at least one-fifth the width of the bucket.

FIG. 3 indicates another barrier 170 that could be used instead of the barrier 90. The barrier 170 can extend along the entire longitudinal M length of the first side portion 91 of the bucket at a height above more than half the bucket height G. There is possibly a slot where water at 160 would hit the barrier. An opening 172 allows for the outflow of water in the dump position.

Thus, the invention provides a dump bucket toilet that avoids large splashing of water when the bucket is tipped to its dump position, which avoids scooping up water by the dump bucket returning away from the dump position so the tank can have a lower height, and which assures that the bucket will return to the fill position after each cycle and with minimum noise. A barrier lying above most of a first side portion of the upright (fill position) bucket prevents the sudden dumping of a large portion of water in the bucket when the bucket tilts to the dump position, and consequent splashing. Instead, water lying along most of the length of the bucket flows down to the bottom of the barrier to more slowly flow into the tank. An opening for the water can lie between the top of the bucket first side and the barrier and/or in one of them. The bucket forms a hold-down container that traps a considerable portion of the original water so it cannot rapidly flow out through a first end portion of the bucket that is kept open to receive water through the refill valve. An axillary container provides slight additional delay before the bucket starts pivoting back towards the refill position. A return wall at the bottom of the upright bucket, traps a quantity of water and holds the water there when the bucket has pivoted only partially back from the dump position, to an in between. The torque applied by the water trapped on the return wall, assures that the bucket will return to the upright refill position.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A dump bucket toilet that includes a tank having laterally spaced first and second sides and a dump bucket lying in said tank and pivotable about a longitudinally-extending tilt axis between a fill position wherein first and second bucket sides lie adjacent, respectively, to said first and second tank sides and a dump position wherein said first bucket side has moved downward to dump water into said tank, said dump bucket having primary and secondary end portion spaced along said axis and a refill valve that diverts refill water into said primary end portion, wherein:

said bucket includes a barrier that lies over a portion of water in said bucket that lies laterally between said first bucket side and said tilt axis, in said filled position, said barrier extending along at least a portion of the longitudinal length of the bucket to trap some of the water lying in the bucket and prevent its very rapid release into said tank when the bucket is tilted to said dump position;

said barrier forms an opening near the top of said first bucket side through which water can flow out into said tank more slowly than if said barrier were not present;

said barrier extends along at least half of the longitudinal length of the bucket, but not along said primary end portion.

2. A dump bucket toilet that includes a tank having laterally spaced first and second sides and a dump bucket lying in said tank and pivotable about a longitudinally-extending tilt axis between a fill position wherein first and second bucket sides lie adjacent, respectively, to said first and second tank sides and a dump position wherein said first bucket side has moved downward to dump water into said tank, wherein:

said bucket includes a barrier that lies over a portion of water in said bucket and that lies laterally between said first bucket side and said tilt axis, in said filled position, said barrier extending along at least a portion of the longitudinal length of the bucket, to trap some of the water lying in the bucket and prevent its very rapid release into said tank when the bucket is tilted to said dump position;

said barrier forms an opening near the top of said first bucket side through which water can flow out into said tank more slowly than if said barrier were not present, and including walls forming a hold-down container lying under said barrier, said container having an open side that facsimile primarily toward said second tank side in said filled position and that faces primarily upward in said dump position, said container being open at the bottom of the container in said dump position to empty water lying in the container to flow into the tank.

3. The dump bucket toilet described in claim 2 wherein:

a majority of said barrier lies above said bucket in said filled position, whereby a volume under the barrier and above the top of the bucket is filled by some of the water dumped out of said bucket as the bucket tilts to said dump position to absorb some of the water.

4. A dump bucket toilet comprising:

a tank;

a bucket which lies in said tank, said bucket having a horizontal tip axis, said bucket having a bottom and first and second opposite side portions and a top, as viewed along said tip axis, and said bucket being pivotable in a tip tipping, and rapidly to a dump position wherein said first bucket side is lowered and water in the bucket is dumped into the tank;

a barrier which partially closes an upper portion of said bucket at at least said first side portion of said bucket to reduce the rate at which water is dumped from the bucket into the tank when the bucket is full and is tilted to said dump position;

said barrier having a barrier far side which is closest to said second side wall and said barrier forming a gap at said bucket first side through which water can flow out without flowing above said barrier far side;

said barrier has an average horizontal width that is less than half the maximum width of said bucket between said opposite sides, so some water in the bucket can flow over the barrier when the bucket is first tipped.

5. A dump bucket toilet comprising:

a tank;

a bucket which lies in said tank, said bucket having a horizontal tip axis, said bucket having a bottom and first and second opposite side portions and a top, as viewed along said tip axis, and said bucket being pivotable in a tip direction about said axis from a fill position wherein a filled bucket awaits a tipping, and rapidly to a dump position wherein said first bucket side is lowered and water in the bucket is dumped into the tank;

a barrier which partially closes an upper portion of said bucket at at least said first side portion of said bucket to reduce the rate at which water is dumped from the bucket into the tank when the bucket is full and is tilted to said dump position;

said barrier having a barrier far side which is closest to said second side wall and said barrier forming a gap at said bucket first side through which water can flow out without flowing above said barrier far side;

said barrier extends above a top of said bucket and substantially as part of a cylinder centered on said pivot axis.

6. A dump bucket toilet which includes a tank, a bucket that lies in said tank and that has a horizontal tilt axis, said bucket having a bottom and first and second opposite side portions and a top, as viewed along said tip axis, and said bucket being pivotable in a tip direction about said axis from a fill position wherein a filled bucket awaits a tipping and a dump position wherein said first bucket side is lowered and water in the bucket is dumped into the tank, comprising:

a barrier which partially closes an upper portion of said bucket at at least said first side portion of said bucket to reduce the rate at which water is dumped from the bucket into the tank when the bucket is full and is tilted to said dump position;

at least a portion of said barrier extends above said top of said bucket to better absorb some of the water dumped out of the bucket as the bucket tilts to the dump position.

* * * * *